US009453390B2

(12) United States Patent
Hern et al.

(10) Patent No.: US 9,453,390 B2
(45) Date of Patent: Sep. 27, 2016

(54) SUBTERRANEAN TOOL FOR RELEASE OF DARTS ADJACENT THEIR INTENDED DESTINATIONS

(71) Applicant: Baker Hughes Incorporated, Houston, TX (US)

(72) Inventors: Christopher R. Hern, Kingwood, TX (US); Daniel C. Ewing, Houston, TX (US); Matthew J. Krueger, Houston, TX (US); Jason P. Lacombe, Katy, TX (US); Travis J. Ansohn, Cypress, TX (US); Steve M. Cortez, Katy, TX (US); Michael Ramon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 481 days.

(21) Appl. No.: 14/019,996

(22) Filed: Sep. 6, 2013

(65) Prior Publication Data

US 2015/0068731 A1 Mar. 12, 2015

(51) Int. Cl.

| | |
|---|---|
| ***E21B 33/10*** | (2006.01) |
| ***E21B 33/12*** | (2006.01) |
| ***E21B 34/14*** | (2006.01) |
| ***E21B 33/068*** | (2006.01) |
| *E21B 33/08* | (2006.01) |
| *E21B 33/05* | (2006.01) |

(52) U.S. Cl.

CPC ..... *E21B 34/14* (2013.01); *E21B 33/068* (2013.01); *E21B 33/05* (2013.01); *E21B 33/08* (2013.01)

(58) Field of Classification Search

CPC ..... E21B 34/14; E21B 33/16; E21B 33/12; E21B 33/05; E21B 33/08; E21B 33/068

See application file for complete search history.

(56) References Cited

U.S. PATENT DOCUMENTS

| | | | | |
|---|---|---|---|---|
| 4,452,322 | A | 6/1984 | Jurgens | |
| 4,577,614 | A | 3/1986 | Schoeffler | |
| 6,220,360 | B1 * | 4/2001 | Connell et al. | 166/373 |
| 6,672,384 | B2 * | 1/2004 | Pedersen et al. | 166/75.15 |
| 6,776,228 | B2 | 8/2004 | Pedersen et al. | |
| 6,904,970 | B2 * | 6/2005 | Simson | 166/291 |
| 7,055,611 | B2 * | 6/2006 | Pedersen et al. | 166/386 |
| 7,066,249 | B2 * | 6/2006 | Simson | 166/177.4 |
| 7,100,700 | B2 | 9/2006 | Davis et al. | |
| 7,299,880 | B2 | 11/2007 | Logiudice et al. | |
| 7,802,620 | B2 | 9/2010 | Arce et al. | |
| 8,256,515 | B2 * | 9/2012 | Barbee | 166/291 |

* cited by examiner

*Primary Examiner* — Nicole Coy
(74) *Attorney, Agent, or Firm* — Steve Rosenblatt

(57) ABSTRACT

A subterranean tool can drop multiple objects to landing locations in a tubular string. The tool can keep at least one ball out of the fluid stream until ready for release. A dart or wiper plug can be kept in the fluid stream with an open bypass until axial mandrel movement allows release of the plug or dart. The tool is rotationally locked at a lower location for run in and then can rotationally lock at an upper location upon release of the dart or ball. Axial movement that releases the dart can continue until the ball aligns with a decreasing depth groove so that relative part rotation cams the ball against a leaf spring detent and into the mandrel flow path.

21 Claims, 5 Drawing Sheets

SUBTERRANEAN TOOL FOR RELEASE OF DARTS ADJACENT THEIR INTENDED DESTINATIONS

FIELD OF THE INVENTION

The field of the invention is subterranean tools that can drop multiple objects in a desired sequence from a location near the intended object landing location or locations.

BACKGROUND OF THE INVENTION

Devices that drop balls and darts are used in a variety of applications. For example in cementing the darts are used to wipe a liner clear of cement while dropped balls on seats can be used for allowing building pressure to set tools such as liner hangers/seals that are frequently used in conjunction with equipment for running or setting a liner in existing casing. These devices can be surface mounted on cementing heads for manual or automatic operation by rig personnel or they can be located remotely from a surface location and remotely operated from the surface by fluid flow patterns or remotely actuated detents that can release a potential energy force to launch a ball.

U.S. Pat. No. 4,452,322 shows in FIG. 2 a split view of a ball retained by a sliding sleeve with a flow passage through it. Fluid flow patterns with a j-slot overcome a resisting spring force and ultimately shifts the sleeve to align a port in the sleeve with a ball for gravity release of the ball. U.S. Pat. No. 7,100,700 uses high flow rates to create axial movement to release a ball at a subterranean location that is stored out of the fluid stream until released. Various surface mounted manually operated ball droppers are illustrated in U.S. Pat. No. 6,776,228 where a fork-shaped device straddles a ball and with rotation turns the ball into the flowpath. In U.S. Pat. No. 7,802,620 a handle is turned 180 degrees to cam a ball through an outlet as shown in FIG. 2. Finally, U.S. Pat. No. 4,577,614 shows in FIG. 2 a remotely released detent that allows the potential energy of a spring to push balls out over the bias of a retaining leaf spring.

U.S. Pat. No. 7,299,880 shows a bypass that stays open to allow running of casing without surging the well where the bypass can be closed in the event of a well pressure event.

Some completion assemblies require torque transmitting capabilities and in some applications the ability to drop a ball on a seat if an earlier dropped dart fails to seat so a tool can be set. The present invention combines some of these capabilities by allowing release of a wiper plug with a pickup force. The pickup force allows the plug retainers to pivot to release a dart and at the same time at least obstruct a flow bypass that allowed flow around the dart before it was released. During running in and until the dart is released the tool components are rotationally locked at a first location and the lock at the first location releases when the plug is launched with an axial pick up force. Further picking up aligns a trapped ball in an axial slot in a mandrel with a mandrel exit hole where relative rotation then can cam the ball toward the exit hole and into the mandrel bore. The released ball can be a backup to set the same tool the dart was intended to set or it can set another tool altogether. The further axial movement to release the ball also engages an upper rotational lock to allow torque transmission for operation of other tools.

Those skilled in the art will more readily appreciate additional aspects of the present invention from a review of the detailed description of the preferred embodiment and the associated drawings while recognizing that the full scope of the invention is to be determined from the appended claims.

SUMMARY OF THE INVENTION

A subterranean tool can drop multiple objects to landing locations in a tubular string. The tool can keep at least one ball out of the fluid stream until ready for release. A dart or wiper plug can be kept in the fluid stream with an open bypass until axial mandrel movement allows release of the plug or dart. The tool is rotationally locked at a lower location for run in and then can rotationally lock at an upper location upon release of the dart or ball. Axial movement that releases the dart can continue until the ball aligns with a decreasing depth groove so that relative part rotation cams the ball against a leaf spring detent and into the mandrel flow path.

BRIEF DESCRIPTION OF THE DRAWINGS

FIG. 1 is a section view of the tool during running in;

DETAILED DESCRIPTION OF THE PREFERRED EMBODIMENT

Figure 1:
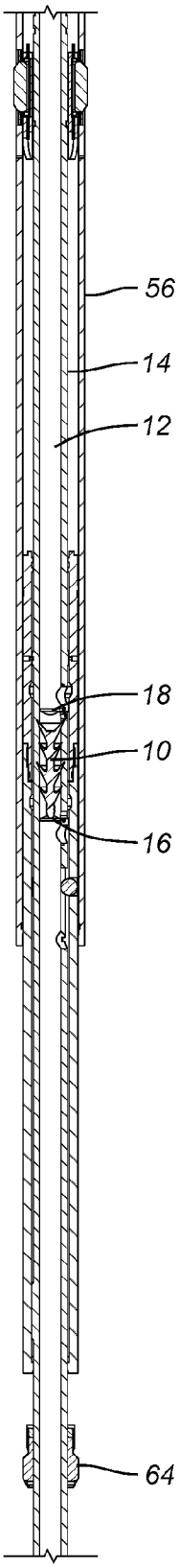
Figure 2:
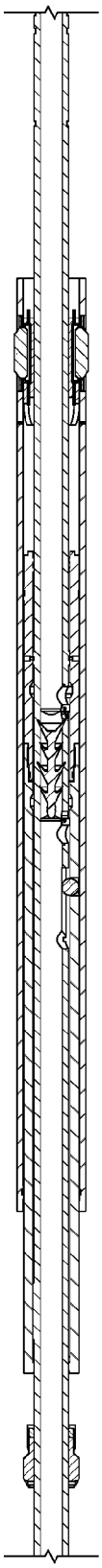
FIG. 2 is the view of FIG. 1 with an initial pickup force and before the dart is released.
Figure 3:
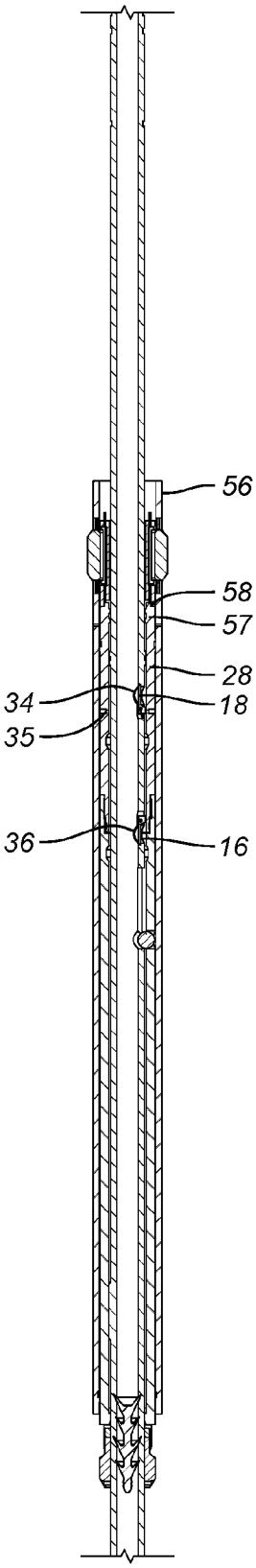
FIG. 3 is the view of FIG. 2 with the dart released from further picking up.
Figure 4:
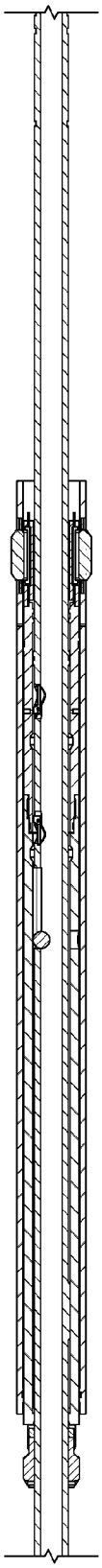
FIG. 4 is the view of FIG. 3 with the ball aligned with an exit port in the mandrel so rotation can cam the ball into the mandrel using a decreasing radius surface.
Figure 5:
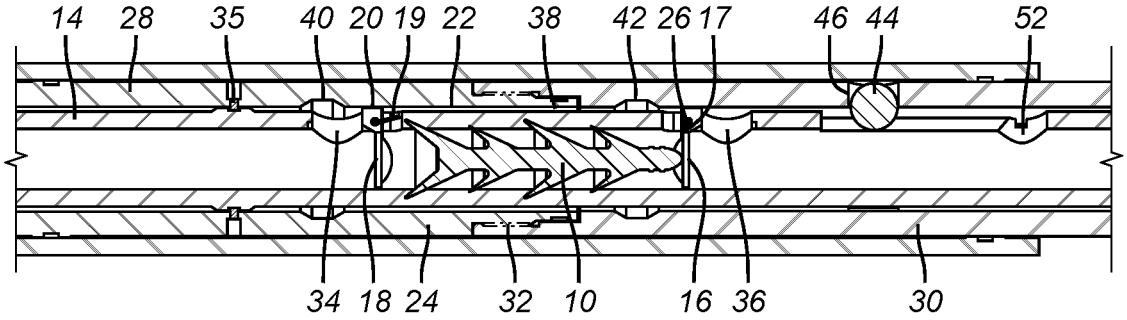
FIG. 5 is an enlarged view of a portion of FIG. 1.

Referring to FIG. 1 the relevant portions of the tool are illustrated. In the preferred embodiment a liner that is not shown is being cemented and the dart or wiper plug 10 is supported in the flow path 12 of the mandrel 14 by pivoting retainers 16 and 18. Looking at FIG. 5 for an enlarged view, it can be seen that in the run in position of FIGS, 1 and 5 the pivoting retainers 16 and 18 have an end 20 that abuts surface 22 of the middle sleeve assembly 24 such that rotation about the pivot pin 26 cannot happen. Middle sleeve assembly 24 has an upper member 28 that is connected to lower member 30 at thread 32. Mandrel 14 is pinned to upper member 28 at pin or pins 35 for run in. There is a flow bypass around the plug 10 with an entrance at 34 and an exit at 36 in an annular path 38 between the mandrel 14 and the middle sleeve assembly 24. Upon raising the mandrel 14 the recesses 40 and 42 align with the ends 20 so that the retainers 16 and 18 can both pivot to release the plug 10. The reason for the two retainers 16 and 18 is to hold the plug 10 in position against flow that can come in opposed directions. When the retainer 16 pivots to the release position that is shown in FIG. 3 it obstructs the exit 36 sufficiently to let applied pressure and the weight of the plug 10 to start the plug 10 moving downhole until it clears the exit 36 so that the plug can then be pumped the rest of the way to its intended destination downhole.

Figure 10:
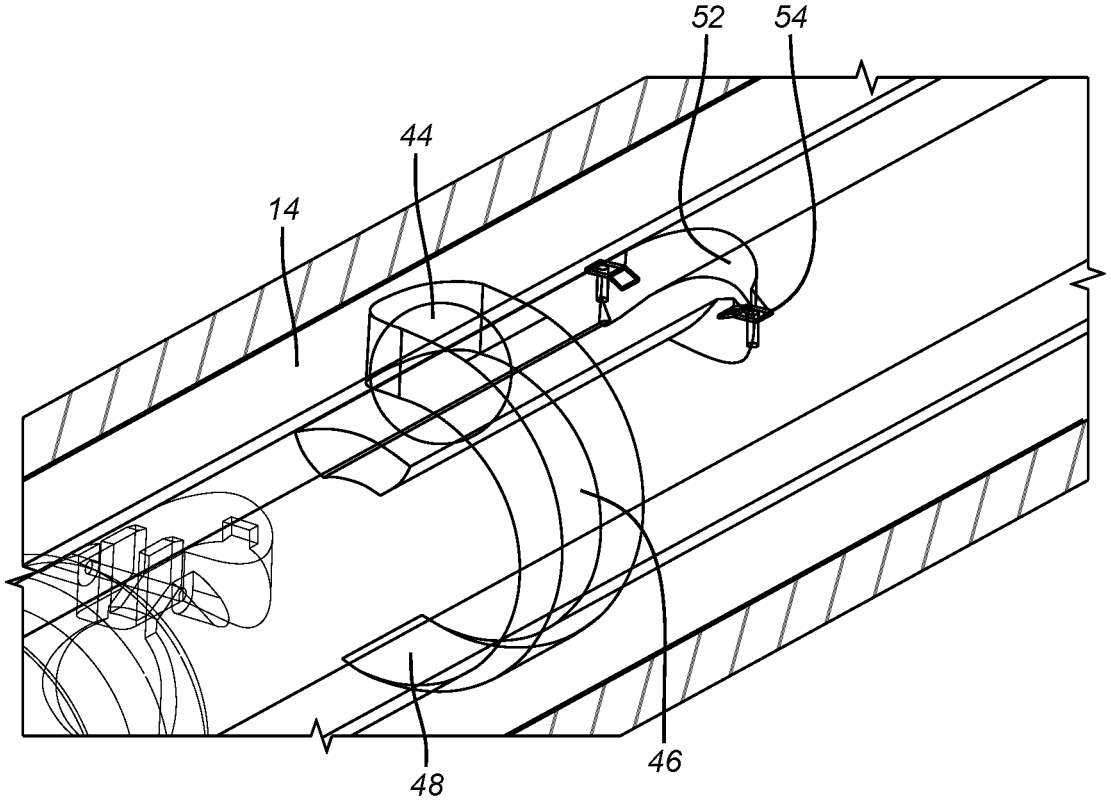
FIG. 10 is a perspective see through run in view showing the ball retained in the groove that has a decreasing radius and in an offset position from the exit port.
Figure 11:
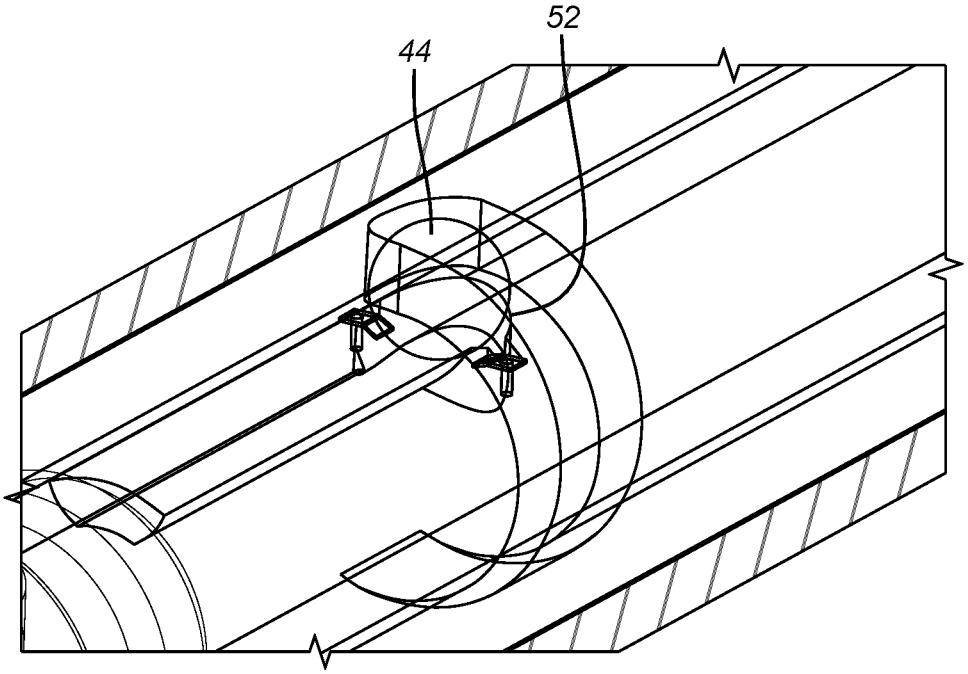
FIG. 11 is the view of FIG. 10 showing alignment of the ball with the mandrel exit port so that relative rotation cams the ball through the exit port overcoming a spring detent.
Figure 12:
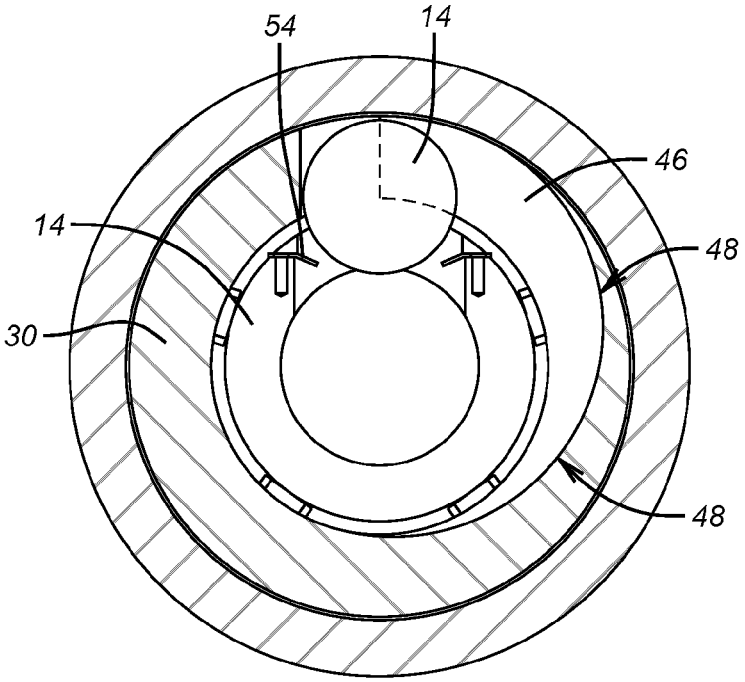
FIG. 12 is the view of FIG. 11 with the ball in the deepest part of the groove before relative rotation has started.
Figure 13:
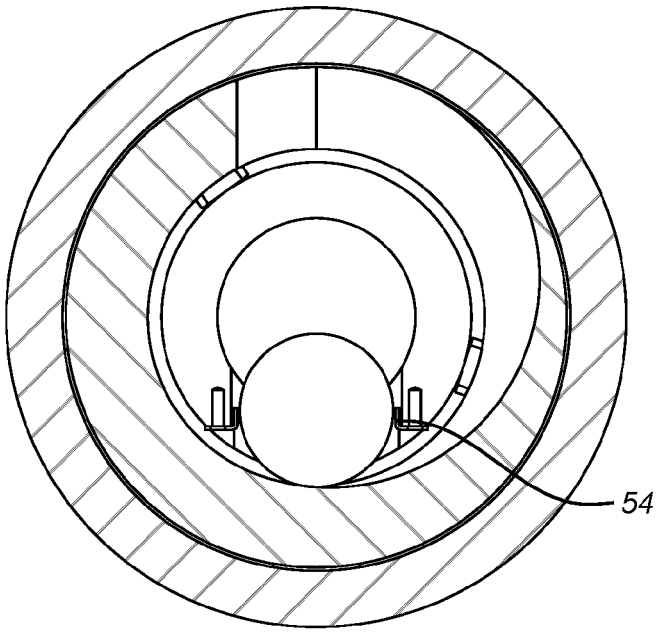
FIG. 13 is the view of FIG. 12 showing how rotation has cammed the ball past the detent so the ball can exit into the mandrel bore.

Also in the run in position there is a ball 44 that is located in a circumferential groove 46 as better seen in FIG. 10. The bottom surface 48 of the groove 46 that is located in lower member 30 has a decreasing radius. The ball 44 is initially at an end of an axial slot 50 that terminates in an exit opening 52 that is sized bigger than the diameter of the ball 44. The slot 50 allows the mandrel 14 to be lifted while the ball 44 is retained substantially within the wall of lower member 30. At the end of the axial movement of the mandrel 14 the ball 44 is in registry with the opening 52 but still retained out of the mandrel passage 12 by a schematically illustrated detent 54 that is best see in FIG. 12 where the ball 44 is shown in the largest diameter of groove 46. It can be seen that relative rotation of the mandrel 14 with respect to the lower member 30 will advance ball 44 along the decreasing radius of bottom surface 48. Since the ball 44 at the time the relative rotation starts is axially aligned with opening 52 the result of the relative rotation will be to cam the ball 44 through the detent 54 allowing the ball to release into passage 12 to its ultimate destination further downhole. The detent 54 is schematically illustrated in FIG. 13 as having been pushed out of the way so that the ball 44 is free to fall into the passage 12 where it can travel by gravity or by being pumped to its end destination on a ball seat (not shown) that can then be used to pressure up to operate the same tool as the plug 10 was supposed to operate as a backup feature or some completely distinct tool can be operated with a landed ball 44.

Figure 8:
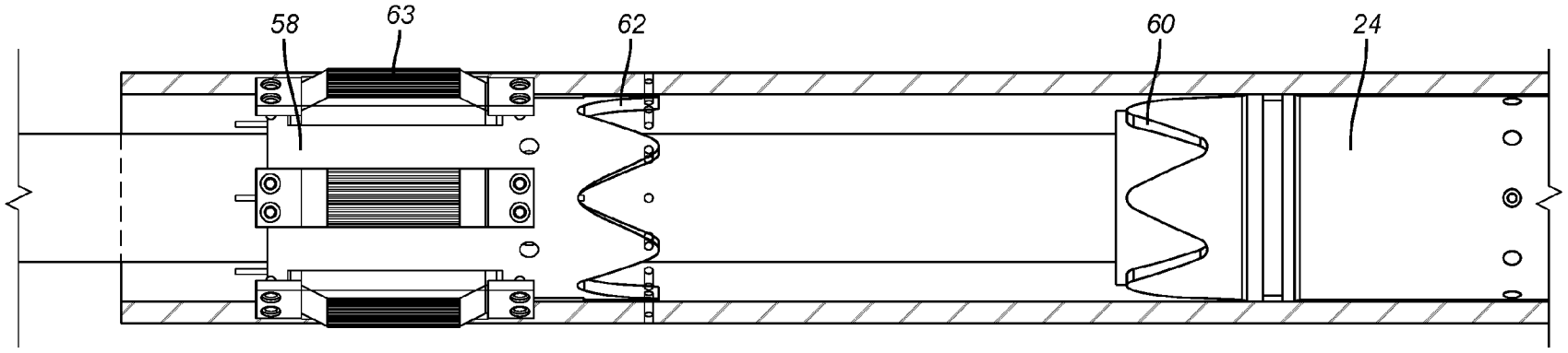
FIG. 8 is a perspective view near the top of the mandrel showing the upper rotational locking feature disengaged.
Figure 9:
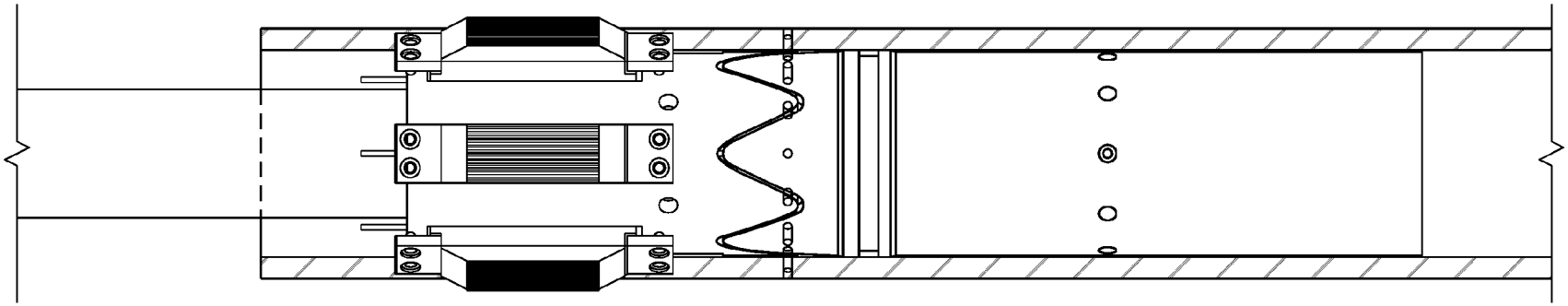
FIG. 9 is the view of FIG. 8 after picking up to release the dart showing the upper rotational lock engaged.

Referring back to FIGS. 1-4 the general sequence of operation is that the outer sleeve 56 is fixed in the wellbore such as with an attached packer that is not shown. The mandrel 14 is raised axially until the retainers 16 and 18 mounted to respective pivot pins 26 rotate when the recesses 40 and 42 have been raised to align with the ends 20. Before this happens the shear pin or pins 34 break so that the mandrel 14 is no longer restrained to move axially in tandem with the sleeve assembly 24. The shear pin or pins 35 break in the FIG. 3 position when the top end 57 of member 28 hits the drag block housing 58 that is supported by outer sleeve 56 which is in turn otherwise fixed in the wellbore with a packer or anchor that is not shown and the mandrel 14 is further pulled up with additional force. That same FIG. 3 position now has the ball 44 aligned with port 52 so that a subsequent rotation of the mandrel 14 while the sleeve assembly 24 is held against rotation by the meshing of teeth 60 and 62 ejects the ball 44 into the passage 12. This is best seen when comparing FIG. 8 for the run in position and FIG. 9 for the meshed position of teeth 60 and 62 so that the sleeve assembly 24 is held fixed as the rotation of mandrel 14 ejects the ball 44 to the passage 12. The splines 66 and 68 release as upward movement of the mandrel 14 moves the travel stop 64 against the bottom of the sleeve assembly 24 and pushing the sleeve assembly 24 against teeth 62 to again rotationally lock the sleeve assembly against rotation so that mandrel 14 rotation will expel ball 44. The meshed splines 66 and 68 insure that the ball 44 that rides on decreasing radius surface 48 will not jam the mandrel 14 to the sleeve assembly 24 until it is time to eject the ball 44 with rotation.

Figure 6:
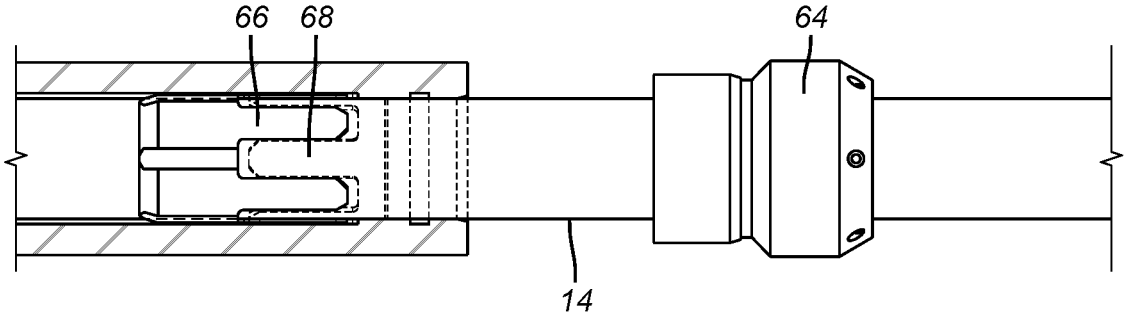
FIG. 6 is a perspective run in view at a lower end of the mandrel showing rotational locking between the mandrel and a surrounding sleeve.
Figure 7:
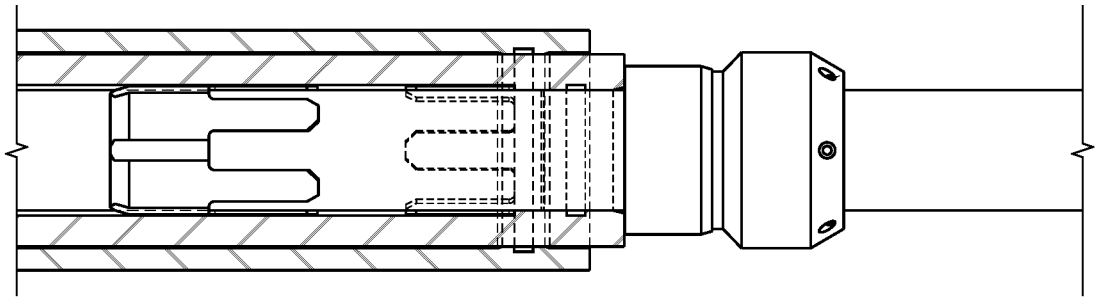
FIG. 7 is the view of FIG. 6 after a pickup force that releases the dart showing the release of the lower rotational locking.

Referring to FIGS. 1 and 6 there is a travel stop assembly 64 on the mandrel 14 as well as a spline 66 that meshes with spline 68 that is internal to the sleeve assembly 24. The splines 66 and 68 are engaged for run in to rotationally lock the mandrel 14 to the sleeve assembly 24. As the mandrel 14 is picked up, the splines 66 move away from engagement from splines 68 and the teeth 60 and 62 ultimately mesh as the plug 10 is released and rotation then cams out the ball 44 into the mandrel passage 12. Picking up the mandrel 14 will cause the sleeve assembly 24 to bottom on the travel stop 64 such that further raising of the mandrel 14 will bring teeth 60 and 62 together such that subsequent mandrel 14 rotation as the sleeve assembly 24 is held against rotation by the meshed teeth allows camming out of ball 44.

Those skilled in the art will appreciate that the present invention allows bringing balls or plugs close to their ultimate destination before release. The plug that is in the mandrel flow path is bypassed for normal circulation flow and the plug is retained in position against flow in the mandrel passage in either one of two opposed directions. The mandrel is rotationally locked to the surrounding sleeve for run in with splines that separate as the mandrel is picked up. Picking up the mandrel allows the retainers for the plug to pivot out of the way with one of the retainers moving over one of the bypass ports to aid the plug in its initial movement beyond the bypass so that its own weight or pressure above can deliver the plug to the desired location.

While the mandrel and the surrounding sleeve assembly are initially pinned for tandem movement, picking up the mandrel releases the lower splines between the two and with a bottom travel stop on the mandrel brings the surrounding sleeve assembly to an upper travel limit where teeth mesh to retain the sleeve assembly against rotation while the mandrel can be turned to cam out a ball into the mandrel passage by pushing the ball past a bias and along a decreasing radius arc on a now stationary sleeve assembly and through a port that has come into alignment with the ball as a result of raising the mandrel.

While a single ball is shown as being released additional balls can also be used as well as multiple plugs by just adding additional facilities as those that are described for the ball and plug that are illustrated. While a cement application for a liner hanger is the preferred application, other completion or drilling applications are envisioned. While a plug and ball dropper are illustrated, they can be used separately depending on the application.

The above description is illustrative of the preferred embodiment and many modifications may be made by those skilled in the art without departing from the invention whose scope is to be determined from the literal and equivalent scope of the claims below:

We claim:

1. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel having spaced wall openings defining a bypass flow passage around at least one selectively retained object that seals said passage;

said object initially supported in said passage and selectively released to travel to the adjacent location;

said mandrel extending outside said housing through said tubular string for remote actuation of said mandrel to release said object to move through said passage and to selectively close one of said spaced wall openings to facilitate use of applied pressure to remove said object from said passage.

2. The tool of claim 1, wherein:

said mandrel and said outer housing defining said bypass flow passage around said object when said object is supported in said mandrel passage;

said object released from said mandrel passage by relative movement between said mandrel and said outer housing.

3. The tool of claim 2, wherein:

said object retained by at least one pivoting support in said mandrel passage that is prevented from pivoting to release said object until relative axial movement between said mandrel and said outer housing.

4. The tool of claim 3, wherein:

said pivoting support pivots as a result of a recess on said outer housing aligning with an end of said pivoting support to allow rotation of said pivoting support.

5. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel having spaced wall openings defining a bypass flow passage around at least one selectively retained object in said passage;

said object initially supported in said passage and selectively released to travel to the adjacent location;

said mandrel extending outside said housing through said tubular string for remote actuation of said mandrel to release said object to move through said passage;

said mandrel and said outer housing defining said bypass flow passage around said object when said object is supported in said mandrel passage;

said object released from said mandrel passage by relative movement between said mandrel and said outer housing;

said object retained by at least one pivoting support in said mandrel passage that is prevented from pivoting to release said object until relative axial movement between said mandrel and said outer housing;

said pivoting support pivots as a result of a recess on said outer housing aligning with an end of said pivoting support to allow rotation of said pivoting support;

said spaced wall openings straddle said object when said object is supported in said passage;

said at least one pivoting support comprises at least two pivoting supports so that each said wall opening has an adjacent pivoting support;

at least one of said pivoting supports pivots to at least partially obstruct a said adjacent spaced wall opening.

6. The tool of claim 5, wherein:

said object is a dart or wiper plug or ball.

7. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel having spaced wall openings defining a bypass flow passage around at least one selectively retained object in said passage;

said object initially supported in said passage and selectively released to travel to the adjacent location;

said mandrel extending outside said housing through said tubular string for remote actuation of said mandrel to release said object to move through said passage;

said mandrel and said outer housing defining said bypass flow passage around said object when said object is supported in said mandrel passage;

said object released from said mandrel passage by relative movement between said mandrel and said outer housing;

at least one second object initially stored outside said mandrel and selectively positioned to move through a second object wall opening in said mandrel to travel to said adjacent or another location.

8. The tool of claim 7, wherein:

said mandrel is rotated relatively to a sleeve assembly to allow said second object to pass through said wall opening.

9. The tool of claim 7, wherein:

said mandrel is moved axially relatively to a sleeve assembly to allow said second object to pass through said opening.

10. The tool of claim 7, wherein:

said mandrel is moved axially and then rotated relatively to a sleeve assembly to allow said second object to pass through said opening.

11. The tool of claim 7, wherein:

said mandrel is initially rotationally locked to a sleeve assembly at a first location while free to translate axially relative to said sleeve assembly.

12. The tool of claim 11, wherein:

relative axial movement of said mandrel with respect to said sleeve assembly releases said rotational locking at said first location.

13. The tool of claim 11, wherein:

relative axial movement of said mandrel with respect to said sleeve assembly aligns said wall opening with a circumferential groove in said sleeve assembly that contains said second object.

14. The tool of claim 13, wherein:

said circumferential groove has a decreasing radius surface that cams said second object through said wall opening on relative rotation of said mandrel with respect to said sleeve assembly.

15. The tool of claim 13, wherein:

said wall opening further comprises a detent to retain said second object in said wall opening until said relative rotation drives said decreasing radius against said second object to overcome said detent.

16. The tool of claim 15, wherein:

said second object comprises a sphere.

17. The tool of claim 14, wherein:

said sleeve assembly initially rotationally locked to said mandrel with meshing splines.

18. The tool of claim 17, wherein:

said mandrel selectively secured to said sleeve assembly with a shearable member for tandem axial movement until said shear member breaks when said sleeve assembly engages said housing.

19. The tool of claim 18, wherein:

said mandrel having a travel stop that engages said sleeve assembly after said shearable member is broken with relative axial movement of said mandrel with respect to said sleeve assembly;

said travel stop pushing said sleeve assembly to rotationally lock with said housing.

20. The tool of claim 19, wherein:

said splines release on relative movement between said mandrel and said sleeve assembly that breaks said shearable member.

21. The tool of claim 20, wherein:

said sleeve assembly having engaging members adjacent an opposed end from said splines to mesh with engaging members on said housing when said travel stop brings said sleeve assembly up axially with said mandrel, said engaging members retain said sleeve assembly as said mandrel is rotated to cam said second object, which further comprises a sphere, through said wall opening.

* * * * *